US009161133B2

(12) United States Patent
Nystrom et al.

(10) Patent No.: US 9,161,133 B2
(45) Date of Patent: Oct. 13, 2015

(54) CROSSTALK REDUCTION IN A HEADSET

(71) Applicants: Martin Nystrom, Horja (SE); Andrej Petef, Lund (SE); Sead Smailagic, Lund (SE)

(72) Inventors: Martin Nystrom, Horja (SE); Andrej Petef, Lund (SE); Sead Smailagic, Lund (SE)

(73) Assignee: Sony Corporation, Tokyo (JP)

( * ) Notice: Subject to any disclaimer, the term of this patent is extended or adjusted under 35 U.S.C. 154(b) by 208 days.

(21) Appl. No.: 13/925,020

(22) Filed: Jun. 24, 2013

(65) Prior Publication Data

US 2014/0376753 A1 Dec. 25, 2014

(51) Int. Cl.

| | |
|---|---|
| ***H04R 5/04*** | (2006.01) |
| ***H04R 5/033*** | (2006.01) |
| *H04R 29/00* | (2006.01) |

(52) U.S. Cl.

CPC ..... *H04R 5/04* (2013.01); *H04R 5/033* (2013.01); *H04R 29/00* (2013.01); *H04R 29/001* (2013.01)

(58) Field of Classification Search

None

See application file for complete search history.

(56) References Cited

U.S. PATENT DOCUMENTS

| | | | |
|---|---|---|---|
| 6,019,639 | A | 2/2000 | Brunker et al. |
| 7,925,030 | B2 | 4/2011 | Holmstrom et al. |
| 2011/0096931 | A1 | 4/2011 | Ormin |
| 2011/0237136 | A1 | 9/2011 | Straka et al. |
| 2012/0262230 | A1 | 10/2012 | Llewellyn et al. |

*Primary Examiner* — Paul Huber

(74) *Attorney, Agent, or Firm* — Tucker Ellis LLP

(57) ABSTRACT

A method for reducing crosstalk in a headset connected to an audio device, in which the includes a left headphone, a right headphone and a common ground for the left headphone and the right headphone includes determining a frequency dependent impedance of the headset. The method also includes determining a frequency dependent impedance of the common ground, and determining a frequency dependent substantially optimum cross feed for attenuating crosstalk in at least one of the left headphone and the right headphone based on the impedance of the headset and the frequency dependent impedance of the common ground. The method further includes applying the frequency dependent substantially optimum cross feed to attenuate the crosstalk in the at least one of the left headphone and the right headphone.

20 Claims, 10 Drawing Sheets

CROSSTALK REDUCTION IN A HEADSET

BACKGROUND

Crosstalk in headsets is an unwanted phenomenon in which a sound played in one stereo channel is also heard in the other channel. All stereo and multichannel audio equipment suffer from varying degrees of crosstalk. Crosstalk in audio transmission applications is normally declared in specifications of audio performance parameters, such as frequency response, distortion, etc. Audio transmission applications have varying degrees of sensitivity to crosstalk (e.g., crosstalk in these applications may have different distortion effects and/or perceptibility). For example, three-dimensional (3D) audio with audio filtered by head related transfer functions requires low crosstalk.

Crosstalk in headsets arises mainly due to the wiring of the headphones. The wiring in audio headsets includes a common ground lead that connects both ear speakers to the input/output jack. There are impedances in all the leads, so that an applied voltage (i.e., a music signal) is divided over the resistances in the leaders and the speaker element. The part of the signal separated by the common ground impedance is heard in the second channel because the common ground is directly fed to the second ear speaker. Crosstalk may be reduced in headsets by specifying a maximum allowed impedance in the leads and in the input/output jack (e.g., a 3.5 mm connector).

SUMMARY

In one implementation, a computer-implemented method for reducing crosstalk in a headset connected to an audio device, in which the headset includes a left headphone, a right headphone and a common ground for the left headphone and the right headphone may include determining a frequency dependent impedance of the headset, determining a frequency dependent impedance of the common ground, determining, by a processor associated with the audio device, a frequency dependent substantially optimum cross feed for attenuating crosstalk in at least one of the left headphone and the right headphone based on the impedance of the headset and the frequency dependent impedance of the common ground, and applying the frequency dependent substantially optimum cross feed to attenuate the crosstalk in the at least one of the left headphone and the right headphone.

In addition, determining the frequency dependent impedance of the headset may further include applying a test signal to one of the left headphone or the right headphone, wherein the test signal is not applied to the other of the left headphone or the right headphone, identifying a voltage of the test signal applied to the one of left headphone and the right headphone, measuring a current of the test signal after a fixed resistor associated with the other of the left headphone or the right headphone, and determining the frequency dependent impedance of the headset based on the voltage of the test signal and the measured current of the test signal after the fixed resistor.

In addition, determining the frequency dependent impedance of the headset may further include applying a test signal to one of the left headphone or the right headphone, determining a differential voltage measurement over a fixed resistor provided in series with the one of the left headphone or the right headphone, determining a differential voltage measurement over a connector for the headset to the audio device, and determining the impedance of the headset based on the voltage measurement over the fixed resistor and the differential voltage measurement over the connector.

In addition, determining the frequency dependent impedance of the common ground may further include applying a test signal to one of the left headphone or the right headphone, measuring the test signal over a fixed resistor associated with the other of the left headphone or the right headphone, and determining the frequency dependent impedance of the common ground based on the applied test signal and the measured test signal over the fixed resistor.

In addition, determining the frequency dependent impedance of the common ground may further include applying:

$$Z(f)_{CG} = \frac{U(f)^{*}_{meas}(Z(f)_{Speaker} + R)^2}{R^{*}(U(f)_{test} - U(f)_{meas} - 1) - 2^{*}U(f)^{*}_{meas}Z(f)_{Speaker}}.$$

In which $Z(f)_{CG}$ is a frequency dependent impedance of common ground, $U(f)_{meas}$ is the voltage measurement after the fixed resistor, $Z(f)_{speaker}$ is an impedance of one of the left headphone or the right headphone, R is a value of the fixed resistor, and $U(f)_{test}$ is the voltage of the applied test signal.

In addition, determining the frequency dependent impedance of the common ground may further include applying a test signal to one of the left headphone and the right headphone, measuring the test signal over a first fixed resistor associated with the one of the left headphone or the right headphone, measuring the test signal over a second fixed resistor associated with the other of the left headphone or the right headphone, and determining the frequency dependent impedance of the common ground based on the measured test signal over the first fixed resistor and the measured test signal over the second fixed resistor.

In addition, determining the frequency dependent impedance of the common ground further include applying:

$$Z(f)_{CG} = \frac{U(f)^{*}_{meas2}(Z(f)_{S2} + R)}{U(f)_{meas1} - U(f)_{meas2}}.$$

In which $Z(f)_{CG}$ is a frequency dependent impedance of common ground, $U(f)_{meas1}$ is the voltage measurement over the first fixed resistor, $U(f)_{meas2}$ is the voltage measurement over the second fixed resistor, $Z(f)_{speaker2}$ is an impedance of the other of the left headphone or the right headphone, and R is a value of the second fixed resistor.

In addition, determining the frequency dependent substantially optimum cross feed may further include applying a ratio:

$$\frac{Z(f)_{CG}}{Z(f)_{Speaker} + Z(f)_{CG}}.$$

In which $Z(f)_{CG}$ is a frequency dependent impedance of common ground, and $Z(f)_{speaker}$ is an impedance of one of the left headphone or the right headphone to which an audio signal is applied.

In addition, the computer implemented method may further include determining differential voltage measurements over the left headphone, over a first fixed resistor associated with the left headphone, over the right headphone, and over a second fixed resistor associated with the right headphone, and tuning the frequency dependent substantially optimum cross feed based on the differential voltage measurements over the left headphone, over the first fixed resistor associated with the left headphone, over the right headphone, and over the second fixed resistor associated with the right headphone.

In addition, the audio device may include one or more of a binaural audio system, or a 3D audio system.

In addition, determining the frequency dependent substantially optimum cross feed may further include determining the frequency dependent substantially optimum cross feed for a range of frequencies corresponding to an audio format.

In another implementation, an audio device may include an input socket to receive a headset device, wherein the headset device includes a first headphone, a second headphone and a common ground lead for the first headphone and the second headphone, a memory to store a plurality of instructions, and a processor configured to execute instructions in the memory to determine a frequency dependent impedance of the headset device, determine a frequency dependent impedance of the common ground lead, determine a frequency dependent substantially optimum cross feed for attenuating crosstalk in at least one of the headphones based on the frequency dependent impedance of the headset and the frequency dependent impedance of the common ground lead, and apply the frequency dependent substantially optimum cross feed to attenuate the crosstalk in the at least one of the headphones.

In addition, when determining the frequency dependent impedance of the headset device, the processor is further to apply a test signal to one of the headphones, wherein the test signal is not applied to the other of the headphones, identify a voltage of the test signal applied to the one of headphones, measure a current of the test signal after a fixed resistor associated with the other of the headphones, and determine the frequency dependent impedance of the headset device based on the voltage of the current of the test signal and the measured test signal after the fixed resistor.

In addition, when determining the frequency dependent impedance of the headset device, the processor is further to apply a test signal to the first headphone, determine a differential voltage measurement over a fixed resistor associated with the first headphone, determine a differential voltage measurement over a connector for the headset device to the audio device, and determine the frequency dependent impedance of the headset device based on the voltage measurement over the fixed resistor and the differential voltage measurement over the connector.

In addition, when determining the frequency dependent impedance of the common ground, the processor is further to apply a test signal having a predetermined voltage to the first headphone, measure a current of the test signal after a fixed resistor in series with the second headphone, and determine the frequency dependent impedance of the common ground based on the applied test signal and the measured test signal over the fixed resistor.

In addition, when determining the frequency dependent impedance of the common ground, the processor is further to apply:

$$Z(f)_{CG} = \frac{U(f)^*_{meas}(Z(f)_{Speaker} + R)^2}{R^*(U(f)_{test} - U(f)_{meas} - 1) - 2^*U(f)^*_{meas}Z(f)_{Speaker}}.$$

In which $Z(f)_{CG}$ is a frequency dependent impedance of common ground, $U(f)_{meas}$ is the voltage measurement after the fixed resistor, $Z(f)_{speaker}$ is an impedance of one of the headphones, R is a value of the fixed resistor, and $U(f)_{test}$ is the voltage of the applied test signal.

In addition, headset device may be one of an on-ear design headset or an in-ear design headset.

In addition, audio device may include a fixed resistor in series with an amplifier output to one of the headphones, wherein the fixed resistor is configured to be at least one of shortcut proofing component for an output of the amplifier, or be a part of a high frequency (HF) suppressing system.

In addition, the processor is further to determine differential voltage measurements over the first headphone, and over a first fixed resistor associated with the first headphone, and tune the frequency dependent substantially optimum cross feed based on the differential voltage measurements over the first headphone, and over the first fixed resistor associated with the first headphone.

In yet another implementation, a computer-readable medium includes instructions to be executed by a processor in an audio device, the audio device being connected to a headset that includes a left headphone, a right headphone and a common ground for the left headphone and the right headphone, the instructions including one or more instructions, when executed by the processor, for causing the processor to determine a frequency dependent impedance of the headset, determine a frequency dependent impedance of the common ground, determine, by a processor associated with the audio device, a frequency dependent substantially optimum cross feed for attenuating crosstalk in at least one of the left headphone and the right headphone based on the impedance of the headset and the frequency dependent impedance of the common ground, and apply the frequency dependent substantially optimum cross feed to attenuate the crosstalk in the at least one of the left headphone and the right headphone.

BRIEF DESCRIPTION OF THE DRAWINGS

The accompanying drawings, which are incorporated in and constitute part of this specification, illustrate one or more embodiments described herein and, together with the description, explain the embodiments. In the drawings.

DETAILED DESCRIPTION

The following detailed description refers to the accompanying drawings. The same reference numbers in different drawings may identify the same or similar elements. Also, the following detailed description is exemplary and explanatory only and is not restrictive of the invention, as claimed.

Embodiments described herein relate to devices, methods, and systems for reducing crosstalk in a headset. In implementations described herein, an impedance of a headset and an impedance of a common ground lead is determined. In particular, a frequency dependent substantially optimum cross feed to attenuate cross talk in the headset is determined based on the frequency dependent impedance of the common ground and the impedance of the headset. The frequency dependent substantially optimum cross feed is then applied to reduce cross talk in the headset.

Consistent with embodiments described herein, the cross talk attenuating cross feed may be determined based on differential voltage readings. Additionally, the frequency dependent substantially optimum cross feed may be tuned to further reduce cross talk in the audio headset.

Figure 1B:
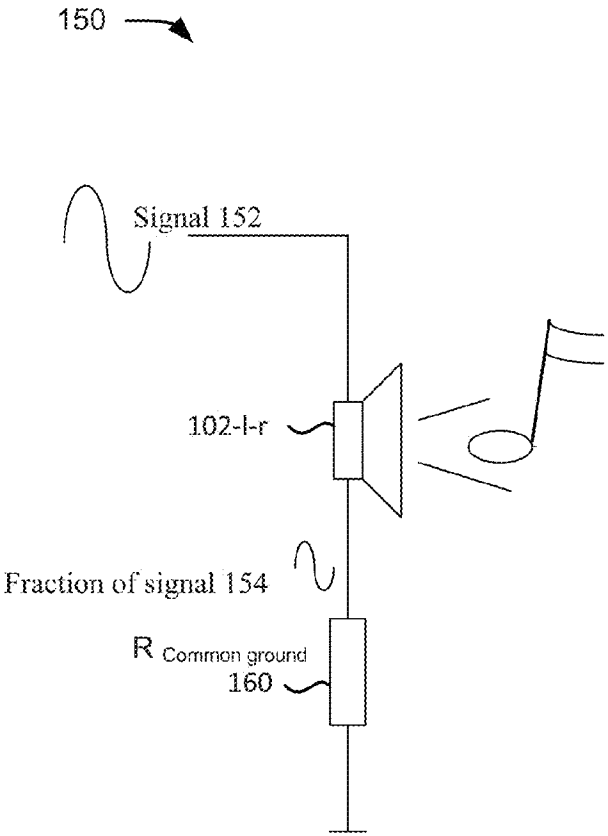
FIGS. 1A and 1B illustrate, respectively, an exemplary headset and an electrical diagram of the headset consistent with embodiments described herein.
Figure 1A:
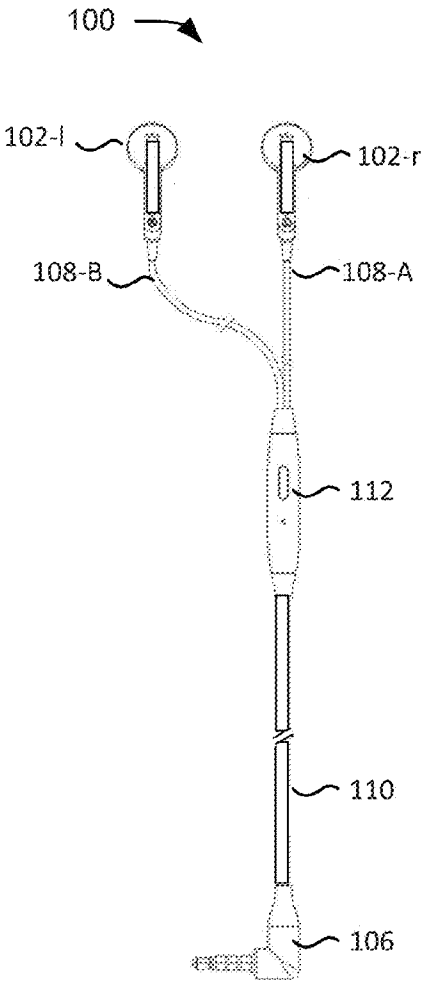

FIGS. 1A and 1B illustrate concepts described herein. More specifically, FIG. 1A shows an exemplary headset 100 and FIG. 1B shows an electrical diagram 150 of headset 100 in an active state (i.e., receiving an audio signal) consistent with embodiments described herein. The configurations of components of headset 100 illustrated in FIGS. 1A and 1B are for illustrative purposes only. Although not shown, headset 100 may include additional, fewer and/or different components than those depicted in FIGS. 1A and 1B. For example, headset 100 may include one or more network interfaces, such as interfaces for receiving and sending information from/to other devices, one or more processors, etc.

As shown in FIG. 1A, headset 100 may include a left headphone 102-L, a right headphone 102-R, and an input/output jack 106 that connects to headphones 102-L and 102-R via wires 108*a* and 108*b*, which may include a common lead 110. Headset 100 is shown as an in-ear design headset, 400 and may have a small form factor with plastic buds or similar design suitable for fitting into the ears of a user. Alternatively, headset 100 may include an on-ear design (not shown) that has a bigger form factor with a padded ear shell and a hoop running either around or on top of the head. In either implementation of headset 100 (i.e., in-ear design or on-ear design), headset 100 may receive audio signals from an attached device (not shown in FIG. 1A) via input/output jack 106. Headset 100 may also include a control button 112 that may allow the user to input instructions for controlling an audio signal from the attached device including pausing, rewinding, skipping, etc. Headphones 102-L and 102-R may include speakers that provide audio in response to the audio signal.

As shown in FIG. 1B, headset 100 may receive an electrical signal 152 (e.g., an audio signal) from an attached device (not shown in FIG. 1B) and provide audio in response to the signal 152 received at the speakers of headphones 102-L-r. Common ground 110 provides a common resistance 160 between left headphone 102-L and right headphone 102-R (i.e., a common impedance between the left and right speakers). A fraction 154 of signal 152 (i.e., signal 152 at a fraction of the signal strength) may be applied to common ground 110 based on voltage division between impedances provided by each of headphones 102-L and 102-R and common ground 110. In instances in which an electrical signal 152 is provided to one speaker, the signal from one speaker will be heard in the other speaker. The signal (i.e., crosstalk) may be heard in the other speaker along with any signal directly applied to the other speaker.

In implementations described herein, systems and methods may determine a frequency dependent substantially optimum cross feed based on an impedance of a headset, and an impedance of a common ground lead. The frequency dependent substantially optimum cross feed may be applied to the headset to attenuate crosstalk. The systems and methods may be applied to stereo and multichannel audio equipment and systems including three-dimensional audio systems (3D) (e.g., 3D audio systems with audio filtered by head related transfer functions (HRTF)), binaural recordings, etc.

Figure 2:
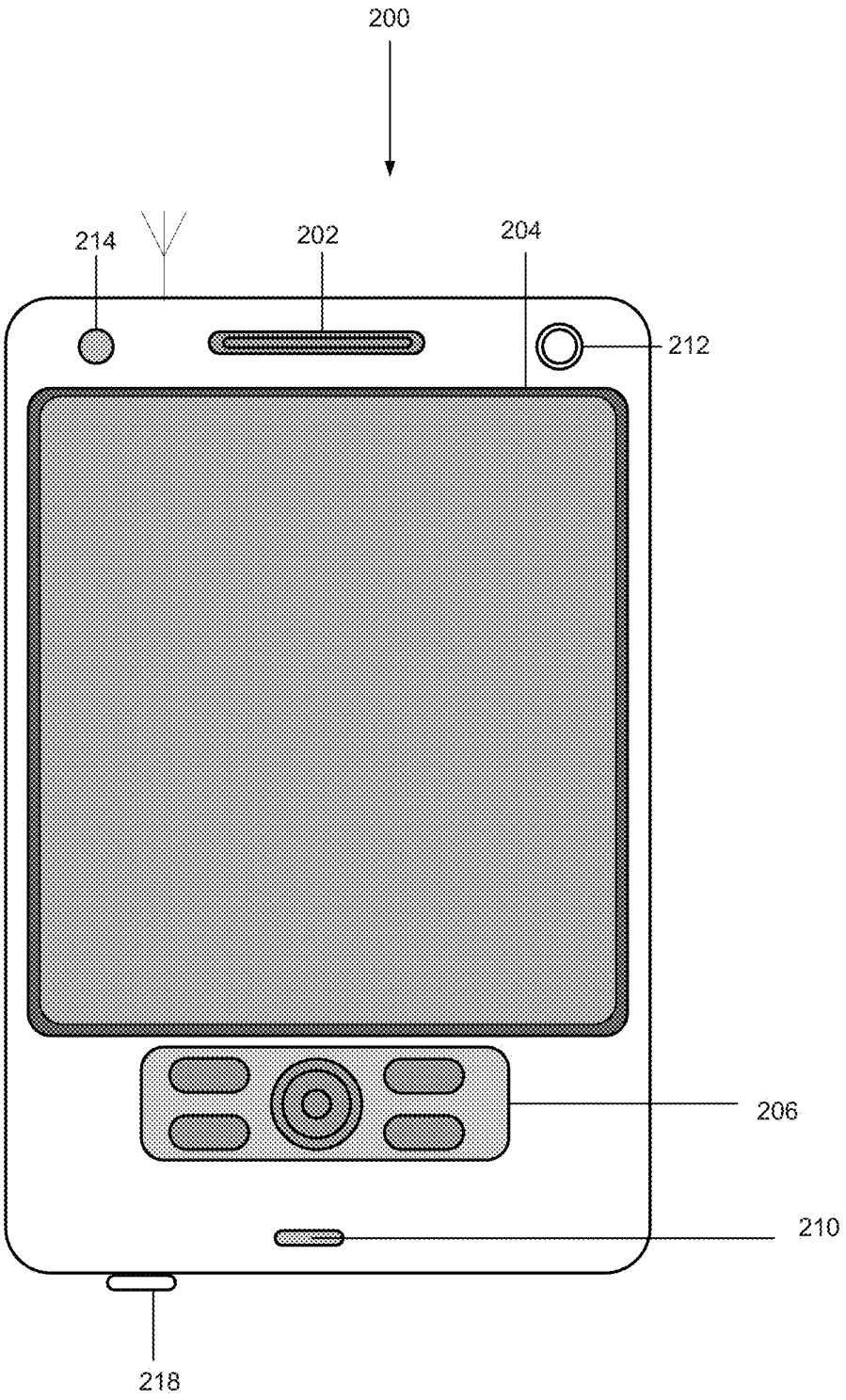
FIG. 2 illustrates an exemplary device consistent with described herein.

FIG. 2 is a diagram of an exemplary audio device 200 in which the concepts described herein may be implemented. Device 200 may include any of the following devices: a music player device (e.g., a Moving Picture Experts Group (MPEG) MPEG-1 or MPEG-2 audio layer III (mp3) player, compact disc (CD) player, cassette player, etc.), a mobile telephone; a cellular phone; a personal communications system (PCS) terminal that may combine a cellular radiotelephone with data processing, facsimile, and/or data communications capabilities; an electronic notepad, a tablet computer, a laptop, and/or a personal computer; a personal digital assistant (PDA) that can include a telephone; a gaming device or console; or another type of device that provides an audio signal for a headset.

In this implementation, device 200 may take the form of a mobile phone (e.g., a cell phone). As shown in FIG. 2, device 200 may include a speaker 202, a touchscreen display 204, control buttons 206, a microphone 210, sensors 212, a front camera 214, a housing 216, and a headphone jack socket 218.

Speaker 202 may provide audible information to a user of device 200.

Display 204 may provide visual information to the user, such as an image of a caller, video images, or pictures. In addition, display 204 may include a touchscreen for providing input to device 200. Display 204 may provide hardware/software to detect the coordinates of an area that is touched by user 110. For example, display 204 may include a display panel, such as a liquid crystal display (LCD), organic light-emitting diode (OLED) display, and/or another type of display that is capable of providing images to a viewer. Display 204 may include a transparent panel/surface for locating the position of a finger or an object (e.g., stylus) when the finger/object is touching or is close to display 204.

Control buttons 206 may permit the user to interact with device 200 to cause device 200 to perform one or more operations, such as place or receive a telephone call. In some implementations, control buttons 206 may include a telephone keypad (not shown) that may be complementary to graphical user interface (GUI) objects generated on touchscreen display 204. Microphone 210 may receive audible information from the user. Sensors 212 may collect and provide, to device 200, information (e.g., acoustic, infrared, etc.) that is used to aid the user in capturing images or in providing other types of information (e.g., a distance between a user and device 200). Front camera 214 may enable a user to view, capture and store images (e.g., pictures, video clips) of a subject in front of device 200. Housing 216 may provide a casing for components of device 200 and may protect the components from outside elements.

Headphone jack socket 218 may receive an input/output jack of a headset, such as the headset described above with respect to FIGS. 1A and 1B. Device 200 may output an audio signal to a headset connected via headphone jack socket 218.

Figure 3:
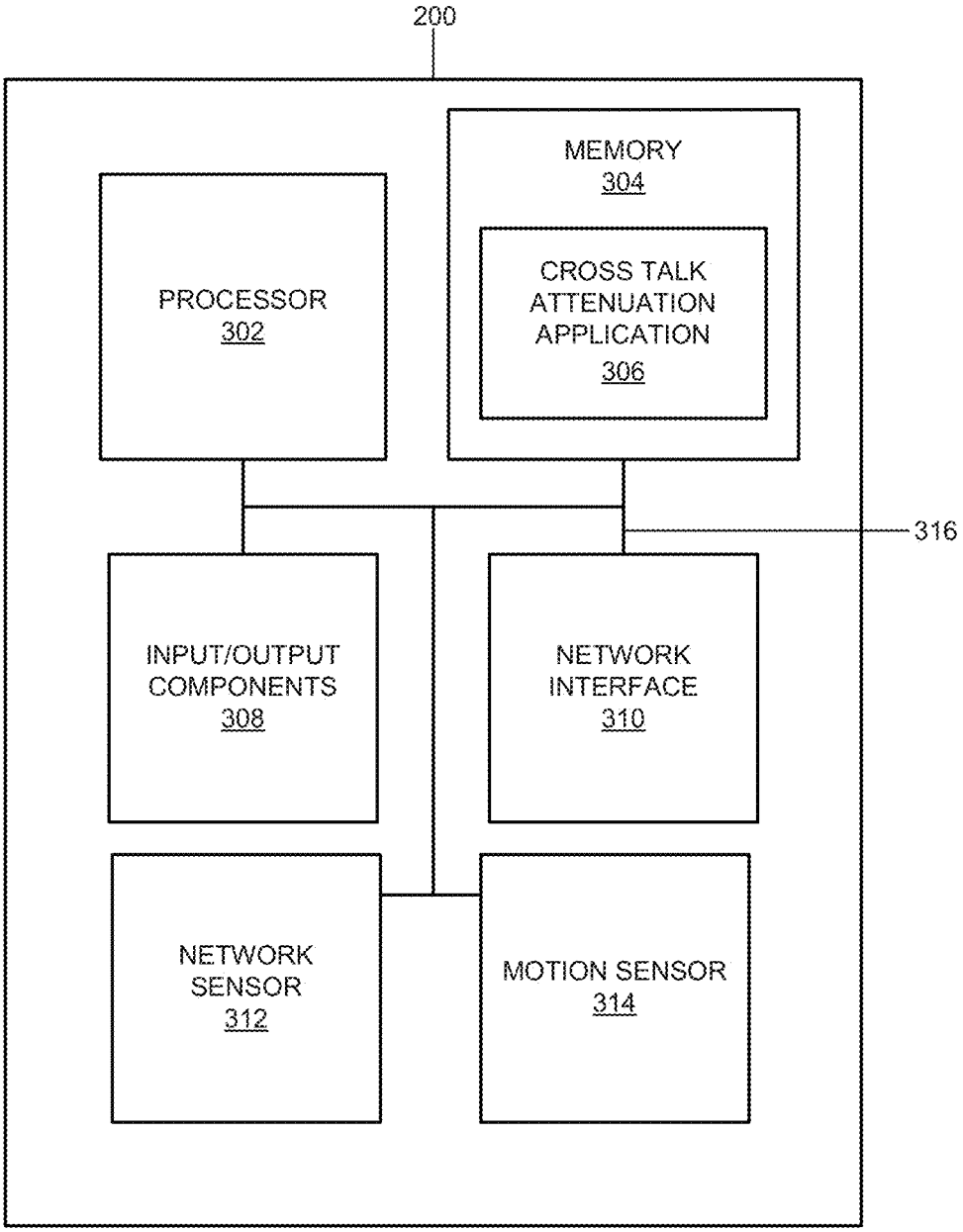
FIG. 3 is a block diagram of exemplary components of the device of FIG. 2.

FIG. 3 is a block diagram of the device of FIG. 2. As shown in FIG. 3, device 200 may include a processor 302, a memory 304, input/output components 308, a network interface 310, a touch sensor 312 and a communication path 316. In different implementations, device 200 may include additional, fewer, or different components than the ones illustrated in FIG. 3. For example, device 200 may include additional network interfaces, such as interfaces for receiving and sending data packets.

Processor 302 may include a processor, a microprocessor, an Application Specific Integrated Circuit (ASIC), a Field Programmable Gate Array (FPGA), and/or other processing logic (e.g., audio/video processor) capable of processing information and/or controlling device 200.

Memory 304 may include static memory, such as read only memory (ROM), and/or dynamic memory, such as random access memory (RAM), or onboard cache, for storing data and machine-readable instructions. Memory 304 may also include storage devices, such as a floppy disk, CD ROM, CD read/write (R/W) disc, and/or flash memory, as well as other types of storage devices.

Memory 304 may include a cross talk attenuation application 306. Cross talk attenuation application 306 may include data and machine-readable instructions to determine a frequency dependent substantially optimum cross feed to be applied to reduce crosstalk in a headset. Cross talk attenuation application 306 may be executed by processor 302. Cross talk attenuation application 306 may include machine-readable instructions to determine an impedance of a headset and an impedance of a common ground for both headphones of the headset.

Input/output components 308 may include a display screen (e.g., touchscreen display 204, etc.), a keyboard, a mouse, a speaker, a microphone, a Digital Video Disk (DVD) writer, a DVD reader, Universal Serial Bus (USB) lines, and/or other types of components for converting physical events or phenomena to and/or from digital signals that pertain to device 200.

Network interface 310 may include a transceiver that enables device 200 to communicate with other devices and/or systems. For example, network interface 310 may include mechanisms for communicating via a network, such as the Internet, a terrestrial wireless network (e.g., a WLAN), a cellular network, a satellite-based network, a WPAN, etc. Additionally or alternatively, network interface 310 may include a modem, an Ethernet interface to a LAN, and/or an interface/connection for connecting device 200 to other devices (e.g., a Bluetooth interface).

Communication path 316 may provide an interface (e.g., a bus) through which components of device 200 may communicate with one another.

Figure 4A:
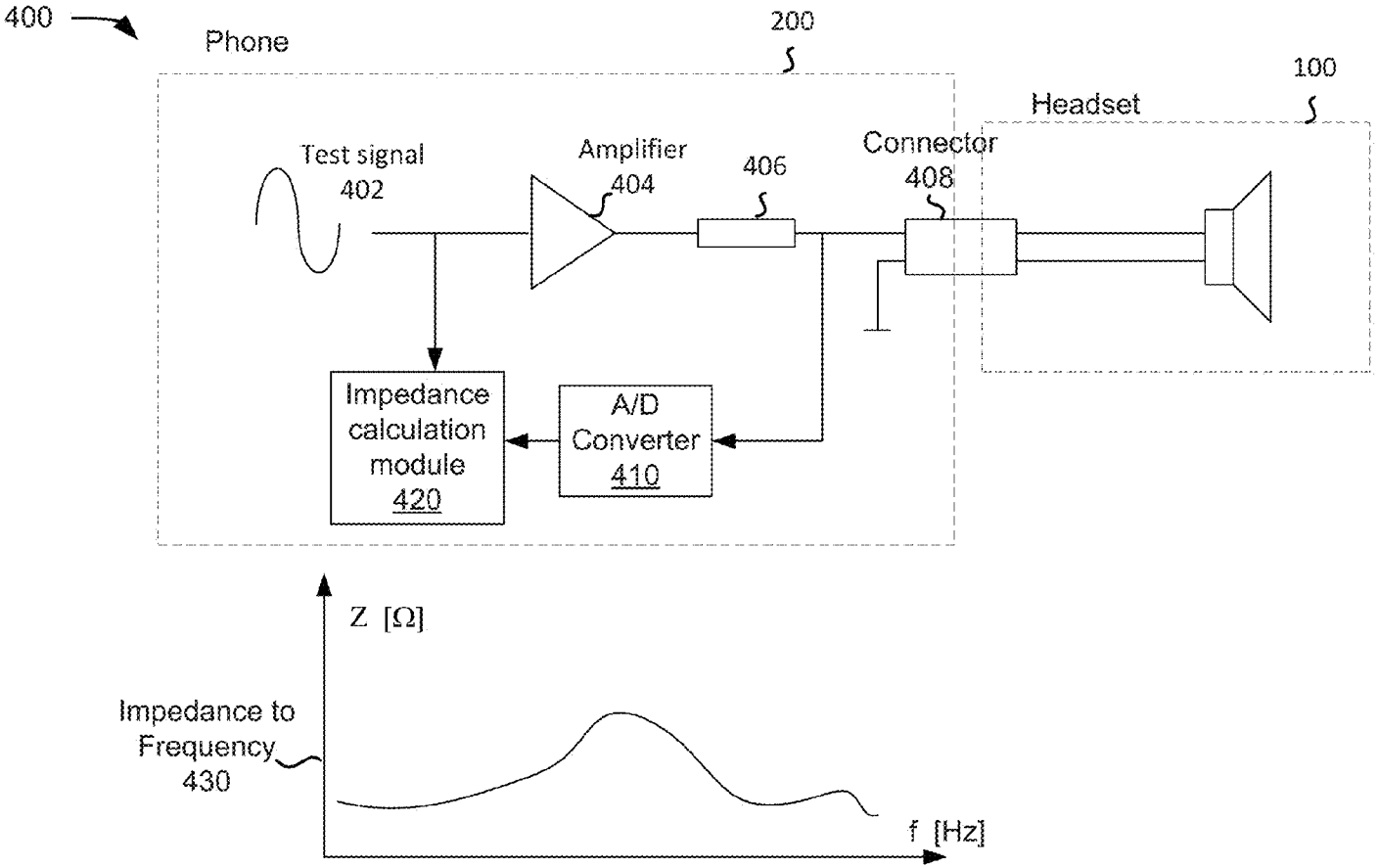
FIGS. 4A and 4B are block diagrams illustrating concepts described herein for determining an impedance of a headset.
Figure 4B:
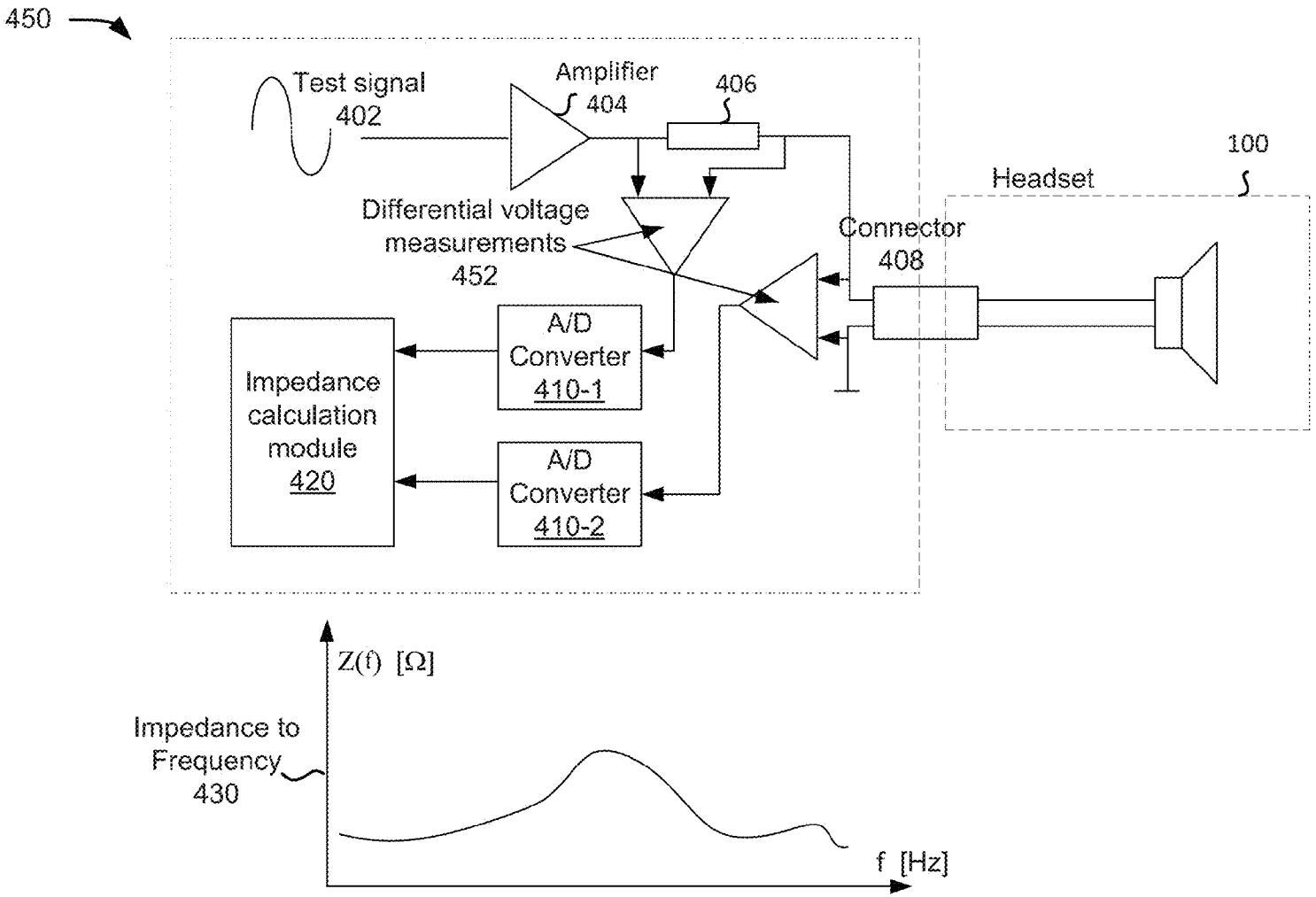

FIGS. 4A and 4B are block diagrams that illustrate configurations 400 and 450, respectively, for measuring an impedance of a headset 100 that is connected to a device 200. Device 200 may include an amplifier 404, a fixed resistor 406, a connector 408 (which may correspond to, or be the same as, headphone jack socket 218 in FIG. 2), one or more analog to digital (A/D) converters 410 and an impedance calculation module 420. Although not shown, device 200 may include additional, fewer and/or different components than those depicted in FIGS. 4A and 4B.

As shown in FIG. 4A, device 200 may generate a test signal 402 to be applied in determining the impedance of headset 100. For example, device 200 may generate test signal 402 when headset 100 is detected. In other instances the audio signal (e.g., an audio signal generated by a user application, such as a song playing on device 200) may function as test signal 402. Test signal 402 may be increased by amplifier 404 and output over fixed resistor 406 to headset 100. Amplifier 404 may be an electronic amplifier that may increase an amplitude of test signal 402. Fixed resistor 406 may be a resistor with a known impedance (e.g., a 10 Ohm resistor) in series with the amplifier 404 output. Fixed resistor 406 may make the amplifier output shortcut proof (that is, resistor 406 may function as a shortcut proofing component for an output of amplifier 404), and may also be a part of a high frequency (HF) suppressing system.

As shown in FIG. 4A, test signal 402 is measured (i.e., a voltage of test signal 402) by impedance calculation module 420 before sending through amplifier 404 and identified as one input of an impedance calculation for headset 100. Test signal 402 is also measured after fixed resistor 406 (e.g., a current measurement by a spare microphone input) and converted by an analog/digital (A/D) converter 410.

Impedance calculation module 420 may determine impedances of components of headset 100 and/or device 200. For example, impedance calculation module 420 may perform an impedance calculation for headset 100 based on measurement of test signal 402 before sending through amplifier 404 and measurement of test signal 402 output by amplifier 404 after a resistor in the signal path, such as series resistor 406. One measurement represents the current over fixed resistor 406 and the other measurement represents the voltage applied. The frequency dependent impedance of headset 100 may be determined based on these two measurements.

The impedance of headset 100 is frequency dependent and may vary with different frequencies, for example as shown in impedance to frequency graph 430, also shown in FIG. 4A. Impedance calculation module 420 may perform an impedance calculation for each frequency of interest as the output of each impedance calculation is a vector. For example, impedance calculation module 420 may perform impedance calculations for a range of frequencies corresponding to human hearing (e.g., frequencies corresponding to an audio format, such as frequencies sampled in mp3s). In one example, impedance calculation module 420 may also perform an impedance calculation for fingerprint matching of headset 100.

FIG. 4B shows an alternative configuration for measuring the impedance of headset 100. Similarly as described with respect to FIG. 4A, a test signal 402 may be sent to amplifier 404. In this instance however, differential voltage measurements 452 may be made over fixed resistor 406 and over connector 408. The differential voltage measurements 452 may be converted by A/D converters 410 (A/D converter 410-1 corresponding to fixed resistor 406 and A/D converter 410-2 corresponding to connector 408) and provided as inputs for impedance calculation module 420. Impedance calculation module 420 may perform an impedance calculation for headset 100 based on the differential impedance measurements over fixed resistor 406 and at the same time differentially over connector 408 (i.e., the impedance of headset 100).

Figure 5A:
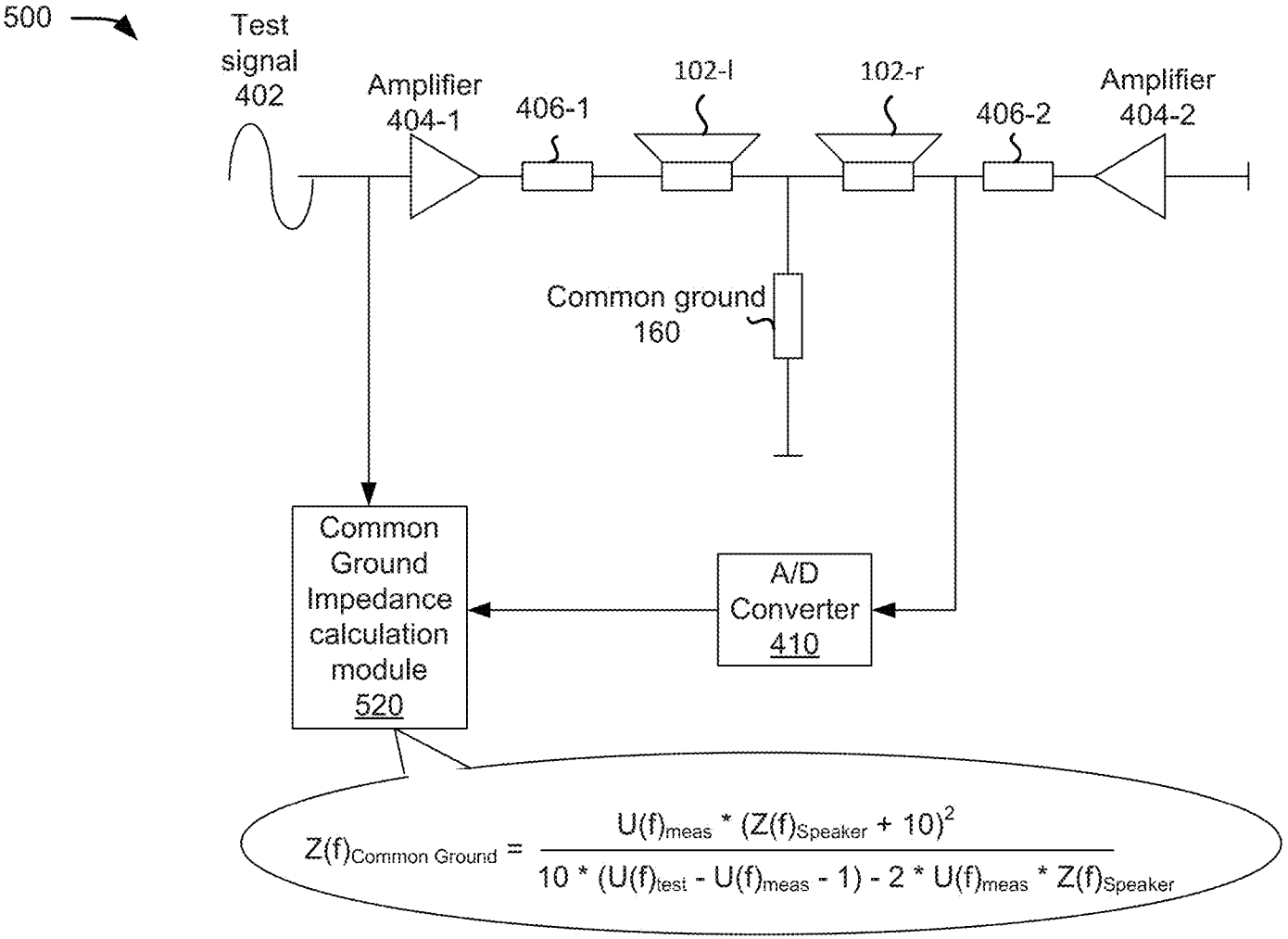
FIGS. 5A and 5B are block diagrams illustrating concepts described herein for determining an impedance of a common ground lead.
Figure 5B:
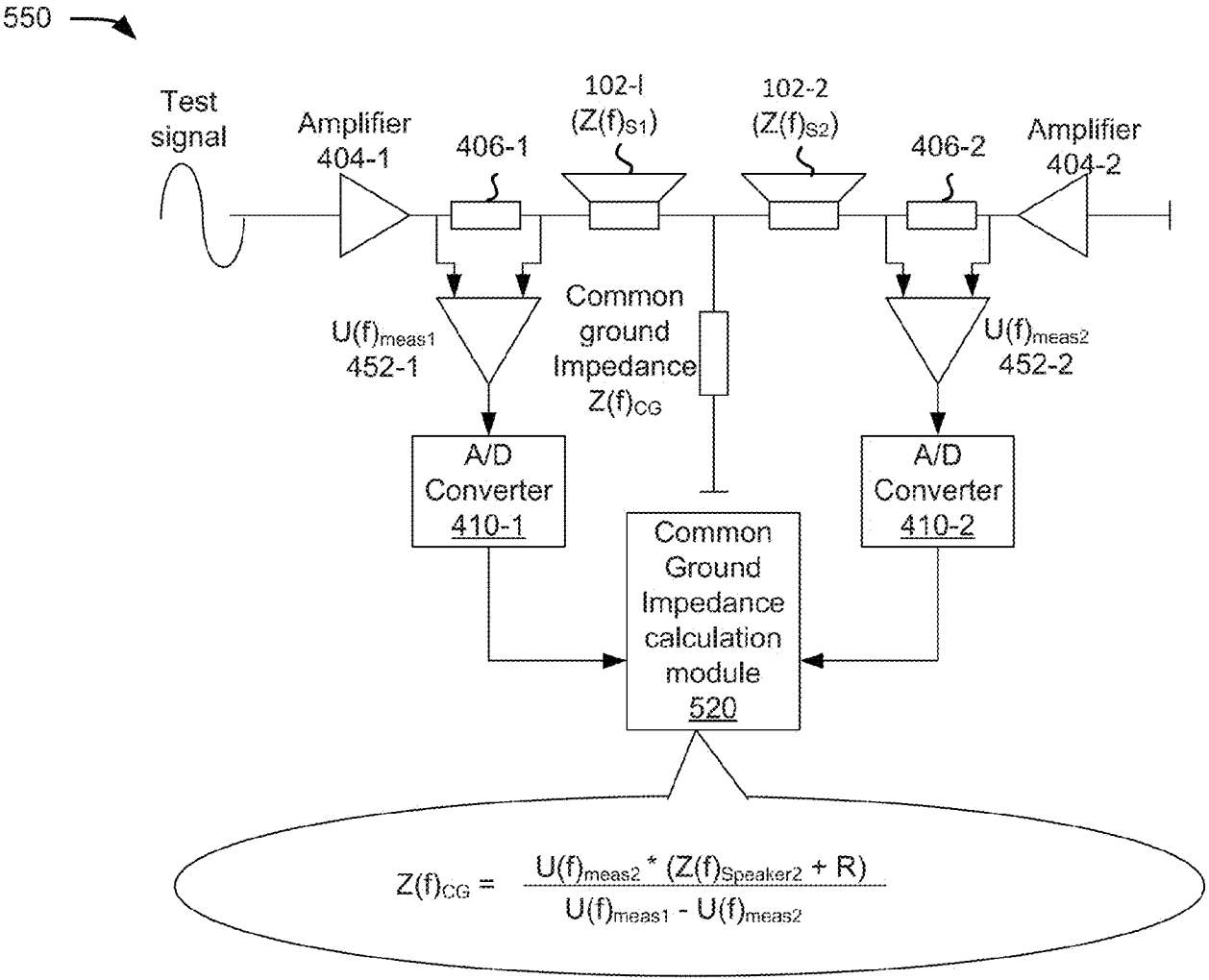

FIGS. 5A and 5B illustrate configurations for measuring an impedance of common ground of headset 100 including portions 500 and 550, respectively, of headset 100 connected to device 200. Although not shown, portions 500 and 550 may include additional, fewer and/or different components than those depicted in FIGS. 5A and 5B.

As shown in FIG. 5A, test signal 402 may be amplified (e.g., by amplifier 404-10 and applied to one channel (e.g., headphone 102-L), and test signal 402 may be amplified (e.g., by amplifier 404-2) and measured over the fixed resistor 406-2 of the other channel (i.e., headphone 102-R in this instance). Common ground impedance calculation module 520 may measure test signal 402 prior to amplification by amplifier 404-1. Common ground impedance calculation module 520 may estimate the resistance in the common ground lead based on these measurements. Common ground impedance calculation module 520 may determine the impedance for different audio frequencies.

In one embodiment, common ground impedance calculation module 520 may determine the dependent impedance of the common ground 160 based on:

$$Z(f)_{CG} = \frac{U(f)^*_{meas}(Z(f)_{Speaker} + R)^2}{R^*(U(f)_{test} - U(f)_{meas} - 1) - 2^*U(f)^*_{meas}Z(f)_{Speaker}}. \quad \text{Eqn. (1)}$$

In which $Z(f)_{CG}$ is the frequency dependent impedance of common ground 160, $U(f)_{meas}$ is the voltage measurement after fixed resistor 406-2 (corresponding to headphone 102-R), $Z(f)_{speaker}$ is the impedance of headphone 102-L, R is the value of fixed resistor 406 (e.g., 10 Ohms), and $U(f)_{test}$ is the voltage of the signal applied to headphone 102-L (i.e., applied test signal 402).

FIG. 5B shows an alternative configuration for measuring the frequency dependent impedance of common ground 160 of headset 100. Headphones 102-L and 102-R have impedances $Z(f)_{S1}$ and $Z(f)_{S2}$, respectively. Similarly as described with respect to FIG. 4B, test signal 402 is applied to one of the headphones 102-L-R (in this instance 102-L) and the measurements in this instance is a differential measurement 452 over resistor 406-1 and over resistor 406-2 ($U(f)_{meas1}$ and $U(f)_{meas2}$, respectively). Common ground impedance calculation module 520 may determine the frequency dependent impedance of the common 160 based on:

$$Z(f)_{CG} = \frac{U(f)^*_{meas2}(Z(f)_{S2} + R)}{U(f)_{meas1} - U(f)_{meas2}} \quad \text{Eqn. (2)}$$

In which $Z(f)_{CG}$ is the frequency dependent impedance of common ground 160, $U(f)_{meas1}$ is the differential voltage measurement over fixed resistor 406-1 (i.e., a first fixed resistor corresponding to headphone 102-R), $U(f)_{meas2}$ is the differential voltage measurement over fixed resistor 406-2 (i.e., a second fixed resistor corresponding to headphone 102-R), $Z(f)_{speaker2}$ is an impedance of the other of the left headphone and the right headphone, and R is the value of fixed resistors 406-1 and 406-2 (for example 10 ohms).

Figure 6:
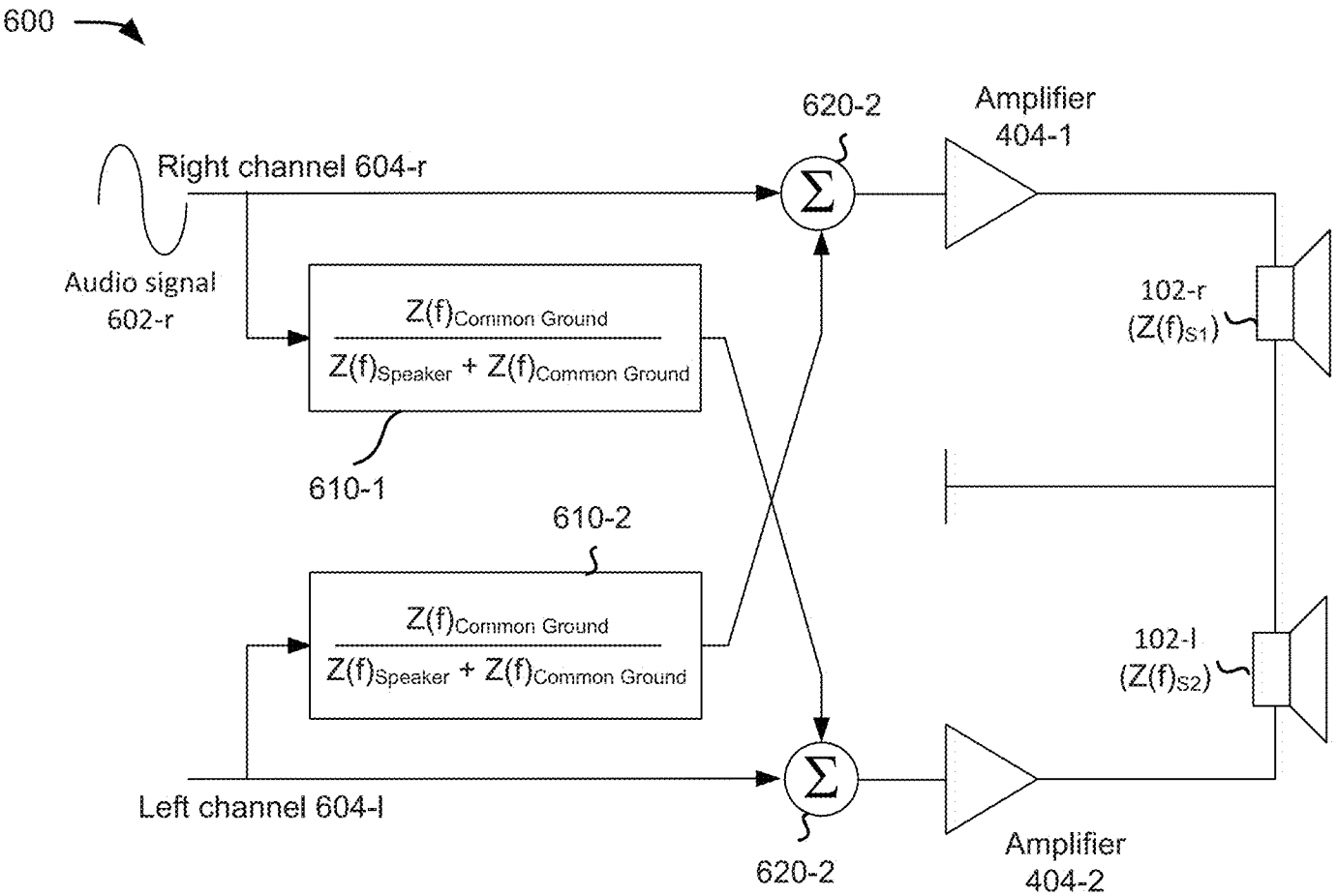
FIG. 6 is a block diagram illustrating concepts described herein for applying a frequency dependent substantially optimum cross feed to attenuate crosstalk in a headset.

FIG. 6 illustrates a configuration 600 for applying a frequency dependent substantially optimum cross feed in a device 200 to reduce crosstalk in a connected headset 100. Configuration 600 includes similar elements of device 200 and headset 100 as described hereinabove with respect to FIGS. 1A to 5B, such as amplifiers 404-1-2 and headphones 102-L-R. In addition, configuration 600 includes cross feed modules 610 (shown as 610-1 and 610-2) and voltage summation points 620 (shown as 620-1 and 620-2).

A frequency dependent substantially optimum cross feed may be determined for each of headphone 102-L and 102-R based on the measured impedance of headset 100 and the measured resistance of common ground 160. For example, a ratio of the frequency dependent substantially optimum cross feed to the signal supplied at the other headphone may be determined based on:

$$\frac{Z(f)_{CG}}{Z(f)_{Speaker} + Z(f)_{CG}} \quad \text{Eqn. (3)}$$

In an instance in which an audio signal 602, which is applied to a particular channel (e.g., audio signal 602-R to right channel 604-R), the magnitude of frequency dependent substantially optimum cross feed ($CF_f$) may be determined by cross feed module 610 (respectively 610-1 and 610-2 for the corresponding cross feeds) based on:

$$CF_f = \frac{AS * Z(f)_{CG}}{Z(f)_{Speaker} + Z(f)_{CG}} \quad \text{Eqn. (4)}$$

In which $Z(f)_{Speaker}$ is an impedance of the speaker that supplies the cross feed and AS is the signal supplied to the speaker that supplies the cross feed. The frequency dependent substantially optimum cross feed is a crosstalk attenuating cross feed that may be applied from a first signal (e.g., 602-R) associated with one headphone to a second signal associated with the other head phone in a stereo system. The frequency dependent substantially optimum cross feed from one channel is summed at voltage summation point 620 (shown as 620-1 and 620-2 for their respective channels) with the cross talk in the other channel. The frequency dependent substantially optimum cross feed is applied based on a function of frequency. The frequency dependent substantially optimum cross feed is of the same polarity as the crosstalk (i.e., positive), resulting in a zero voltage difference over the speaker. The crosstalk attenuating cross feed may be applied to each of the headphones 102-L and 102-R based on the impedance of the other speaker ($Z(f)_{speaker}$) and common ground 160.

The frequency dependent substantially optimum cross feed includes a frequency dependent vector and may be applied as a frequency dependent filter for different frequencies.

Figure 7:
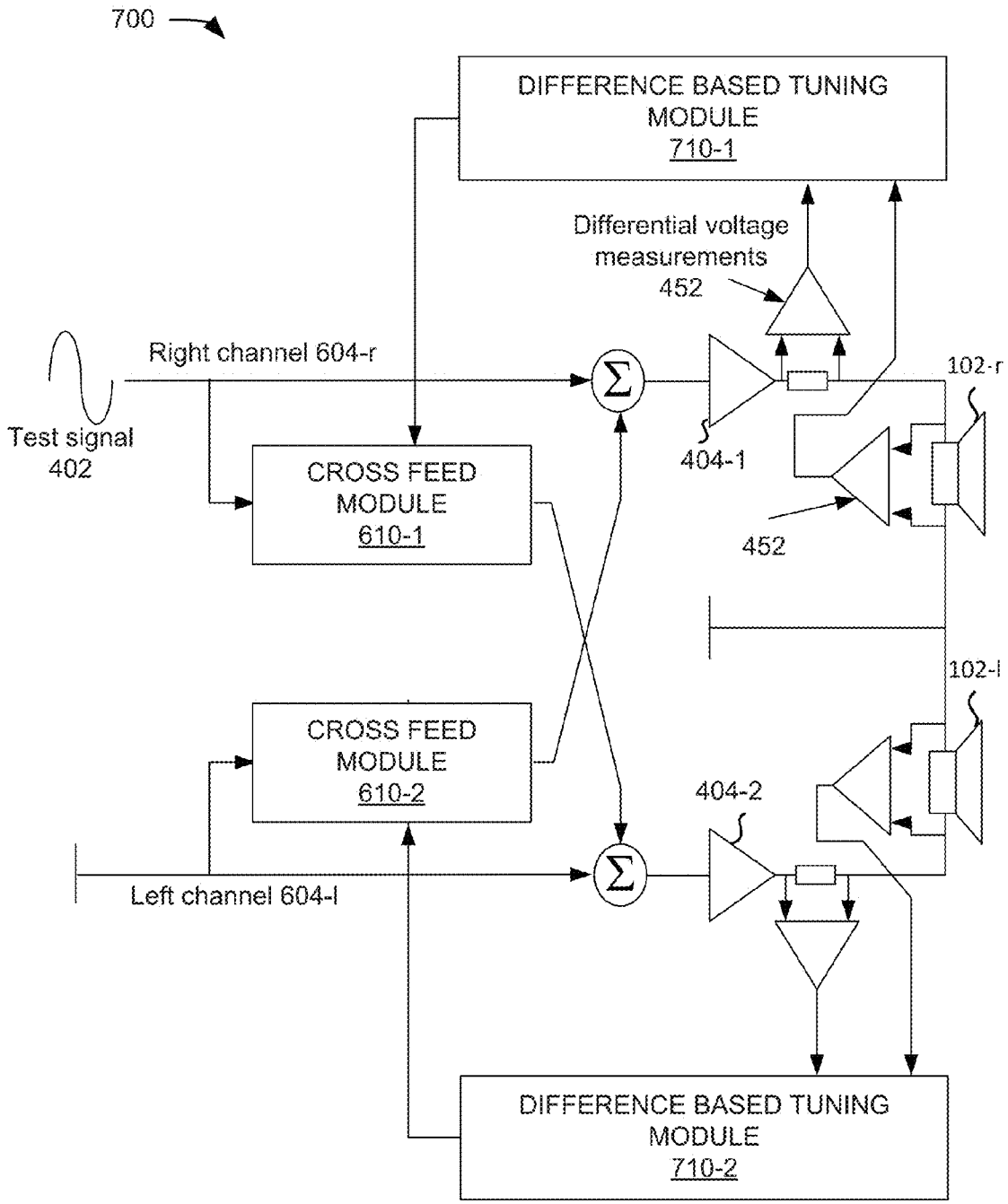
FIG. 7 is a block diagram illustrating concepts described herein for tuning a frequency dependent substantially optimum cross feed applied to attenuate crosstalk in a headset.

FIG. 7 illustrates a configuration 700 for tuning a frequency dependent substantially optimum cross feed in a device 200 to reduce crosstalk in a connected headset 100. Configuration 700 includes similar elements of device 200 and headset 100 as described hereinabove with respect to FIGS. 1A to 6, such as amplifiers 404-1-2 and headphones 102-L-R. In addition, configuration 700 includes difference based algorithm tuning modules 710-1 and 710-2. Although not shown, configuration 700 may include additional, fewer and/or different components than those depicted in FIG. 7.

As shown in FIG. 7, the effect of the cross feed applied to eliminate cross talk can be measured and tuned. Difference based tuning modules 710 may tune the frequency dependent substantially optimum cross feed based on a difference based algorithm. For example, difference based tuning modules 710 may measure voltage over resistors 406 and speakers 102 (i.e., headphones 102). If a signal is applied to a particular channel (e.g., right channel), and frequency dependent substantially optimum cross feed is perfectly matched to the crosstalk, there should be no current through the fixed resistor of the left channel (associated with the crosstalk). If the frequency dependent substantially optimum cross feed is not perfectly matched to the crosstalk, difference based tuning modules 710 may recalibrate frequency dependent substantially optimum cross feed.

In an alternate embodiment, (not shown) difference based tuning module 710 may measure the right channel for an audio signal before amplifier 404 (i.e., the cross feed from left channel only) and measure the current after the fixed resistor. If difference based tuning module 710 determines that there is a signal difference, there is still cross talk, and difference based tuning module 710 may tune frequency dependent substantially optimum cross feed until the measured current is minimized. Difference based tuning module 710 may tune based on an audio signal initially and may continuously and softly tune as available data is accrued and more reliable measurements are made. In some instances the right speaker and left speaker may not be perfectly matched (e.g., a difference of a few ohms). Difference based tuning module 710 may tune frequency dependent substantially optimum cross feed in different ways based on the impedance of the different speakers.

Figure 8:
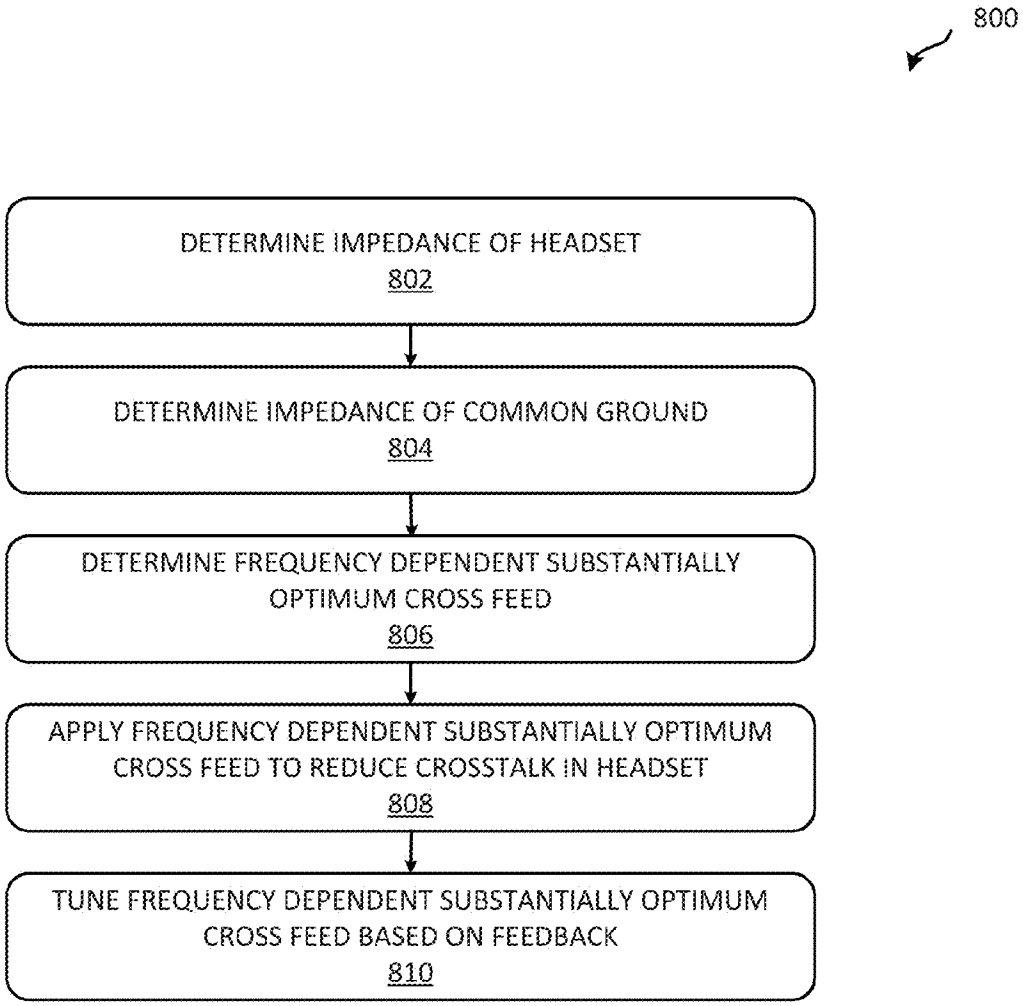
FIG. 8 is a flow diagram of an exemplary process for reducing crosstalk in a headset consistent with implementations described herein.

FIG. 8 is a flowchart of an exemplary process 800 for reducing crosstalk in a headset in a manner consistent with implementations described herein. Process 800 may execute in a device 200 that is connected to a headset 100. It should be apparent that the process discussed below with respect to FIG. 8 represents a generalized illustration and that other elements may be added or existing elements may be removed, modified or rearranged without departing from the scope of process 800.

Device 200 may determine an impedance of a headset (block 802). For example, device 200 may measure current after fixed resistor 406 associated with one headphone 102 (e.g., headphone 102-R) and the other measurement represents the voltage applied to the other headphone 102 (e.g., headphone 102-L), as described above with respect to FIG. 4A. Alternatively, device 200 may perform differential measurements 452 over resistor 406 and over connector 408, such as described above with respect to FIG. 4B. In any event, device 200 may determine the impedance of headset 100 based on the different measurements of an input signal.

At block 804, device 200 may determine an impedance of a common ground. For example, device 200 may determine the frequency dependent impedance of the common ground 160 based on measuring the signal prior to amplification in device 200 and over a speaker, such as described with respect to FIG. 5A. Alternatively, device 200 may determine the frequency dependent impedance of the common ground 160 based on differential measurements 452 over resistor 406 and over connector 408, such as described hereinabove with respect to FIG. 5B.

At block 806, device 200 may determine a frequency dependent substantially optimum cross feed for attenuating crosstalk in at least one of left headphone 102-L and right headphone 102-R. For example, device 200 may determine the frequency dependent substantially optimum cross feed based on the impedance of the headset and the frequency dependent impedance of the common ground, such as described above with respect to FIG. 6.

Device 200 may apply the frequency dependent substantially optimum cross feed to reduce crosstalk in the headset (block 808). For example, device 200 may apply a frequency dependent substantially optimum cross feed based on a signal applied to one channel and the impedance of the speaker to which the signal is applied, such as described with respect to FIG. 6.

At block 810, device 200 may tune the frequency dependent substantially optimum cross feed based on feedback. For example, device 200 may apply a difference based feedback algorithm, such as described with respect to FIG. 7 above.

Systems and methods described herein may determine a frequency dependent substantially optimum cross feed that may be used to reduce crosstalk in headsets. Consistent with embodiments, systems and methods may reduce crosstalk independent of which headset (or headset brand) that is connected.

The foregoing description of implementations provides illustration, but is not intended to be exhaustive or to limit the implementations to the precise form disclosed. Modifications and variations are possible in light of the above teachings or may be acquired from practice of the teachings.

In the above, while series of blocks have been described with regard to the exemplary processes, the order of the blocks may be modified in other implementations. In addition, non-dependent blocks may represent acts that can be performed in parallel to other blocks. Further, depending on the implementation of functional components, some of the blocks may be omitted from one or more processes.

It will be apparent that aspects described herein may be implemented in many different forms of software, firmware, and hardware in the implementations illustrated in the figures. The actual software code or specialized control hardware used to implement aspects does not limit the invention. Thus, the operation and behavior of the aspects were described without reference to the specific software code—it being understood that software and control hardware can be designed to implement the aspects based on the description herein.

It should be emphasized that the term "comprises/comprising" when used in this specification is taken to specify the presence of stated features, integers, steps or components but does not preclude the presence or addition of one or more other features, integers, steps, components, or groups thereof.

Further, certain portions of the implementations have been described as "logic" that performs one or more functions. This logic may include hardware, such as a processor, a microprocessor, an application specific integrated circuit, or a field programmable gate array, software, or a combination of hardware and software.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

What is claimed is:

1. A computer-implemented method for reducing crosstalk in a headset connected to an audio device, wherein the headset includes a left headphone, a right headphone and a common ground for the left headphone and the right headphone, the method comprising:

determining a frequency dependent impedance of the headset;

determining a frequency dependent impedance of the common ground;

determining, by a processor associated with the audio device, a frequency dependent substantially optimum cross feed for attenuating crosstalk in at least one of the left headphone or the right headphone based on the frequency dependent impedance of the headset and the frequency dependent impedance of the common ground, wherein determining the frequency dependent substantially optimum cross feed includes applying a ratio:

$$\frac{Z(f)_{CG}}{Z(f)_{Speaker} + Z(f)_{CG}},$$

wherein $Z(f)_{cG}$ is a frequency dependent impedance of the common ground, and $Z(f)_{speaker}$ is an impedance of one of the left headphone or the right headphone to which an audio signal is applied; and applying the frequency dependent substantially optimum cross feed to attenuate the crosstalk in the at least one of the left headphone or the right headphone.

2. The computer-implemented method of claim 1, wherein determining the frequency dependent impedance of the headset further comprises:

applying a test signal to one of the left headphone or the right headphone, wherein the test signal is not applied to the other of the left headphone or the right headphone;

identifying a voltage of the test signal applied to the one of left headphone or the right headphone;

measuring a current of the test signal after a fixed resistor associated with the other of the left headphone or the right headphone; and determining the frequency dependent impedance of the headset based on the voltage of the test signal and the measured current of the test signal after the fixed resistor.

3. The computer-implemented method of claim 1, wherein determining the frequency dependent impedance of the headset further comprises:

applying a test signal to one of the left headphone or the right headphone;

determining a differential voltage measurement over a fixed resistor provided in series with the one of the left headphone or the right headphone;

determining a differential voltage measurement over a connector for the headset to the audio device; and determining the impedance of the headset based on the differential voltage measurement over the fixed resistor and the differential voltage measurement over the connector.

4. The computer-implemented method of claim 1, wherein determining the frequency dependent impedance of the common ground further comprises:

applying a test signal to one of the left headphone or the right headphone;

measuring the test signal over a fixed resistor associated with the other of the left headphone or the right headphone; and determining the frequency dependent impedance of the common ground based on the applied test signal and the measured test signal over the fixed resistor.

5. The computer-implemented method of claim 4, wherein determining the frequency dependent impedance of the common ground further comprises applying:

$$Z(f)_{CG} = \frac{U(f)^*_{meas}(Z(f)_{Speaker} + R)^2}{R^*(U(f)_{test} - U(f)_{meas} - 1) - 2^*U(f)^*_{meas}Z(f)_{Speaker}},$$

wherein $U(f)_{meas}$ is the voltage measurement after the fixed resistor, R is a value of the fixed resistor, and $U(f)_{test}$ is the voltage of the applied test signal.

6. The computer-implemented method of claim 1, wherein determining the frequency dependent impedance of the common ground further comprises:

applying a test signal to one of the left headphone and the right headphone;

measuring the test signal over a first fixed resistor associated with the one of the left headphone or the right headphone;

measuring the test signal over a second fixed resistor associated with the other of the left headphone or the right headphone; and determining the frequency dependent impedance of the common ground based on the measured test signal over the first fixed resistor and the measured test signal over the second fixed resistor.

7. The computer-implemented method of claim 6, wherein determining the frequency dependent impedance of the common ground further comprises applying:

$$Z(f)_{CG} = \frac{U(f)^*_{meas2}(Z(f)_{S2} + R)}{U(f)_{meas1} - U(f)_{meas2}},$$

wherein $U(f)_{meas1}$ is the voltage measurement over the first fixed resistor, $U(f)_{meas2}$ the voltage measurement over the second fixed resistor, $Z(f)_{S2}$ is an impedance of the other of the left headphone or the right headphone, and R is a value of the second fixed resistor.

8. The computer-implemented method of claim 1, further comprising:

measuring differential voltages across the left headphone, across a first fixed resistor associated with the left headphone, across the right headphone, and across a second fixed resistor associated with the right headphone; and tuning the frequency dependent substantially optimum cross feed based on the differential voltages across the left headphone, across the first fixed resistor associated with the left headphone, across the right headphone, and across the second fixed resistor associated with the right headphone.

9. The computer-implemented method of claim 1, wherein the audio device comprises one or more of a binaural audio system, or a 3D audio system.

10. The computer-implemented method of claim 1, wherein determining the frequency dependent substantially optimum cross feed further comprises:

determining the frequency dependent substantially optimum cross feed for a range of frequencies corresponding to an audio format.

11. An audio device, comprising:

an input socket to receive a headset device, wherein the headset device includes a first headphone, a second headphone and a common ground for the first headphone and the second headphone;

a memory to store a plurality of instructions; and a processor configured to execute instructions in the memory to:

determine a frequency dependent impedance of the headset device, determine a frequency dependent impedance of the common ground, determine a frequency dependent substantially optimum cross feed for attenuating crosstalk in at least one of the headphones based on the frequency dependent impedance of the headset device and the frequency dependent impedance of the common ground lead, apply the frequency dependent substantially optimum cross feed to attenuate the crosstalk in the at least one of the headphones,.

measure differential voltages at the first headphone, and across a first fixed resistor associated with the first headphone; and tune the frequency dependent substantially optimum cross feed based on the differential voltages at the first headphone, and across the first fixed resistor associated with the first headphone.

12. The audio device of claim 11, wherein when determining the frequency dependent impedance of the headset device, the processor is further configured to:

apply a test signal to the first headphone, wherein the test signal is not applied to the second headphone;

identify a voltage of the test signal applied to the first headphone;

measure a current of the test signal after the first fixed resistor; and determine the frequency dependent impedance of the headset device based on the voltage of the test signal and the current of the test signal after the first fixed resistor.

13. The audio device of claim 11, wherein, when determining the frequency dependent impedance of the headset device, the processor is further configured to:

apply a test signal to the first headphone;

determine a differential voltage measurement over the first fixed resistor;

determine a differential voltage measurement over a connector for the headset device to the audio device; and determine the impedance of the headset device based on the voltage measurement over the first fixed resistor and the differential voltage measurement over the connector.

14. The audio device of claim 11, wherein, when determining the frequency dependent impedance of the common ground, the processor is further configured to:

apply a test signal having a predetermined voltage to the first headphone;

measure a current of the test signal after a second fixed resistor in series with the second headphone; and determine the frequency dependent impedance of the common ground based on the predetermined voltage of the test signal and the measured current of the test signal over the second fixed resistor.

15. The audio device of claim 14, wherein, when determining the frequency dependent impedance of the common ground, the processor is further configured to apply:

$$Z(f)_{CG} = \frac{U(f)^{*}_{meas}(Z(f)_{Speaker} + R)^2}{R^{*}(U(f)_{test} - U(f)_{meas} - 1) - 2^{*}U(f)^{*}_{meas}Z(f)_{Speaker}},$$

wherein $Z(f)_{CG}$ is a frequency dependent impedance of the common ground, $U(f)_{meas}$ is the voltage measurement after the second fixed resistor, $Z(f)_{speaker}$ is an impedance of one of the headphones, R is a value of the second fixed resistor, and $U(f)_{test}$ is the voltage of the applied test signal.

16. The audio device of claim 11, wherein the headset device comprises one of an on-ear design headset or an in-ear design headset.

17. The audio device of claim 11, further comprising:

an additional fixed resistor in series with an amplifier output to one of the headphones, wherein the additional fixed resistor is configured to be at least one of shortcut proofing component for an output of the amplifier, or be a part of a high frequency (HF) suppressing system.

18. A non-transitory computer-readable medium including instructions to be executed by a processor in an audio device, the audio device being connected to a headset that includes a left headphone, a right headphone and a common ground for the left headphone and the right headphone, the instructions including one or more instructions, when executed by the processor, for causing the processor to:

determine a frequency dependent impedance of the headset;

determine a frequency dependent impedance of the common ground, wherein determining the frequency dependent impedance of the common ground further comprises:

applying a test signal to one of the left headphone or the right headphone, measuring the test signal at a first fixed resistor associated with the one of the left headphone or the right headphone, measuring the test signal at a second fixed resistor associated with the other of the left headphone or the right headphone, and determining the frequency dependent impedance of the common ground based on the measured test signal at the first fixed resistor and the measured test signal at the second fixed resistor;

determine, by a processor associated with the audio device, a frequency dependent substantially optimum cross feed for attenuating crosstalk in at least one of the left headphone or the right headphone based on the frequency dependent impedance of the headset and the frequency dependent impedance of the common ground; and apply the frequency dependent substantially optimum cross feed to attenuate the crosstalk in the at least one of the left headphone or the right headphone.

19. The non-transitory computer-readable medium of claim 18, further comprising instructions wherein, when determining the frequency dependent impedance of the headset, when executed by the processor, cause the processor to:

apply the test signal to one of the left headphone or the right headphone, wherein the test signal is not applied to the other of the left headphone or the right headphone;

identify a voltage of the test signal applied to the one of left headphone or the right headphone;

measure a current of the test signal after a second fixed resistor associated with the other of the left headphone or the right headphone, wherein the first fixed resistor is associated with the left headphone and the second fixed resistor is associated with the right headphone; and determine the frequency dependent impedance of the headset based on the voltage of the test signal and the measured current of the test signal after the second fixed resistor.

20. The non-transitory computer-readable medium of claim 18, further comprising instructions wherein, when determining the frequency dependent impedance of the headset, when executed by the processor, cause the processor to:

apply the test signal to one of the left headphone or the right headphone;

determine a differential voltage measurement over a second fixed resistor provided in series with the one of the left headphone or the right headphone;

determine a differential voltage measurement over a connector for the headset to the audio device; and determine the impedance of the headset based on the differential voltage measurement over the second fixed resistor and the differential voltage measurement over the connector.

* * * * *